United States Patent [19]

Barreto

[11] Patent Number: 4,610,749

[45] Date of Patent: Sep. 9, 1986

[54] DUCT FORMING MACHINE STRIP MATERIAL ALIGNMENT COMPENSATING SYSTEM

[75] Inventor: Ramon R. Barreto, Burbank, Calif.

[73] Assignee: Serpentine Corporation, San Fernando, Calif.

[21] Appl. No.: 735,077

[22] Filed: May 16, 1985

[51] Int. Cl.[4] ..... B65H 81/00

[52] U.S. Cl. ..... 156/429; 156/143; 242/57.1

[58] Field of Search ..... 242/67.3 R, 67.5, 57.1, 242/68, 68.1, 68.2, 68.3; 156/143, 195, 446, 425, 429, 432, 428

[56] References Cited

U.S. PATENT DOCUMENTS 3,178,123 4/1965 Buddecke ..... 242/67.3 R 4,200,245 4/1980 Bugnone ..... 242/17.1 X 4,536,246 8/1985 McGuire ..... 156/429

*Primary Examiner*—David Simmons

*Attorney, Agent, or Firm*—David O'Reilly

[57] ABSTRACT

This invention relates to a duct forming machine strip material feeder alignment compensating system which permits the adjustment of strip material being fed to a mandrel for forming duct. The strip feeder material is fed from a reel mounted on an adjustable platform. The platform is supported by the machine frame for vertical adjustment by a crank operated lead screw. Horizontal and vertical angular compensating adjustments of the strip material feed system are provided by adjustments of a spool axle mounting plate. The axle mounting plate is horizontally and angularly adjustable to keep strip material being fed from a spool to the mandrel of the duct forming machine in proper alignment.

13 Claims, 5 Drawing Figures

DUCT FORMING MACHINE STRIP MATERIAL ALIGNMENT COMPENSATING SYSTEM

FIELD OF THE INVENTION

This invention relates to duct forming machines and more particularly relates to strip material alignment compensating feed system for a duct forming machine.

BACKGROUND OF THE INVENTION

In one type of duct forming machine, strip material is fed to a mandrel to encapsulate a helical coil of reinforcing wire. The overlapping edges of the strip material are sealed with glue to form a flexible duct core for use in assemblying heating and cooling flexible duct. The flexible strip material has a width of only a few inches with the overlap being substantially less than an inch. It is imperative that this overlap of strip material be properly aligned so that the bonding and encapsulation of the reinforcing wire coil is secure. If the strip material being fed is out of alignment, wrinkles or bubbles can form along the overlapping edges preventing a positive seal.

An additional problem is presented by the strip material being fed from a large spool of material in which misalignments are magnified as the supply reel becomes smaller in diameter. The spool is initially properly aligned so that the strip material is nearly in a horizontal plane when being fed. As the spool diameter decreases, the strip material will be at an increasingly downard angle which can cause problems of alignment as well as glue application.

Therefore it would advantageous if misalignments could be compensated for by accurately readjusting the spool from time to time to prevent improper seals around the reinforcing wire. To insure an efficient smooth seal any adjustment should permit vertical, horizontal as well as angular adjustments to provide proper alignment. Vertical adjustment compensates for the diminishing size of the supply spool.

It is therefore one object of the present invention to provide a duct forming machine having a strip material feed system which has vertical adjustment.

Yet another object of the present invention is to provide a duct forming machine having a strip material feed system having microadjustment control for vertical, horizontal and angular alignment.

BRIEF DESCRIPTION OF THE INVENTION

This invention relates to duct forming machines and strip material feed systems.

The strip material feed system disclosed herein is for use on duct forming machines similar to those shown and described in U.S. Pat. No. 4,351,682 incorporated herein by reference. In the duct forming system of this patent reinforcing wire is fed to a mandrel and wound in a continuing helix. The helix is wound on flexible strip material also fed to the mandrel with the edges of the strip material overlapping and surrounding the reinforcing wire. Hot melt glue is laid on the overlapping edges of the strip material as it is fed to the mandrel so the successive revolutions of the mandrel cause an overlap encapsulating the reinforcing wire. Since the strip material is only a few inches wide and the overlapping area is substantially less than an inch, it is important that the overlap be kept substantially constant. Any misalignment of the strip material may cause wrinkles or bubbles in the overlapping edges or even prevent sufficient overlap to cover the reinforcing wire.

To avoid the above described problem, a microadjustment alignment compensating system is provided for the strip material feed system in the form of a platform mounted for vertical adjustment on the machine by a crank operated lead screw. Operation of the lead screw raises or lowers the platform to keep the strip material in substantially the same horizontal plane as the mandrel. That is, it keeps the strip material substantially horizontal as it is fed to a glue head and the mandrel minimizing an incline which could create a misalignment.

The strip feed material is mounted on an axle supported by a bearing plate mounted on an adjustable platform. There are two bearings supporting the axle as well as a friction brake adjustment to control the feed tension of the strip material. Too little friction can cause the strip material feed to be fed to loosely by feeding excess material while excessive friction can tear the material. Angular adjustment is provided by a thumbscrew threaded through a flange on the mounting platform abutting a flange on the axle mounting plate. Adjustment of the thumbscrew causes angular displacement of the axle supporting the strip material mounting shaft. This permits angular alignment compensation of the strip material.

The mounting platform and bearing plate are mounted substantially horizontal but some adjustment is necessary to provide proper alignment to compensate for any error in mounting of these components. Some slight tilt adjustment is provided in the form of a position locking bolt mounted in a threaded socket beneath the platform which can push up on the axle bearing plate to tilt the plate slightly as needed to provide proper tilt alignment in addition to locking its position after adjustments are completed.

Horizontal alignment or positioning of the strip feed material is provided by gear racks secured to the bearing plate beneath the platform engaging gears on a rotatable crank shaft engaging the rack gears. Rotation on the crank shaft adjusts the horizontal and position of the strip material feed supply reel to provide proper horizontal alignment.

With the various adjustments provided above, accurate vertical, horizontal angular compensating microadjustments to the alignment of the strip material feed supply reel can be made. Thus, errors in the overlapping and sealing of the strip material around the reinforcing wire can essentially be eliminated or reduced to a minimum. Additionally, misalignments magnified by reduction or decrease in the size of the feed supply reel can be easily and quickly compensated for.

The above and other features of the invention will be fully understood from the following detailed description and the accompanying drawings, in which:

DETAILED DESCRIPTION OF THE INVENTION

Figure 1:
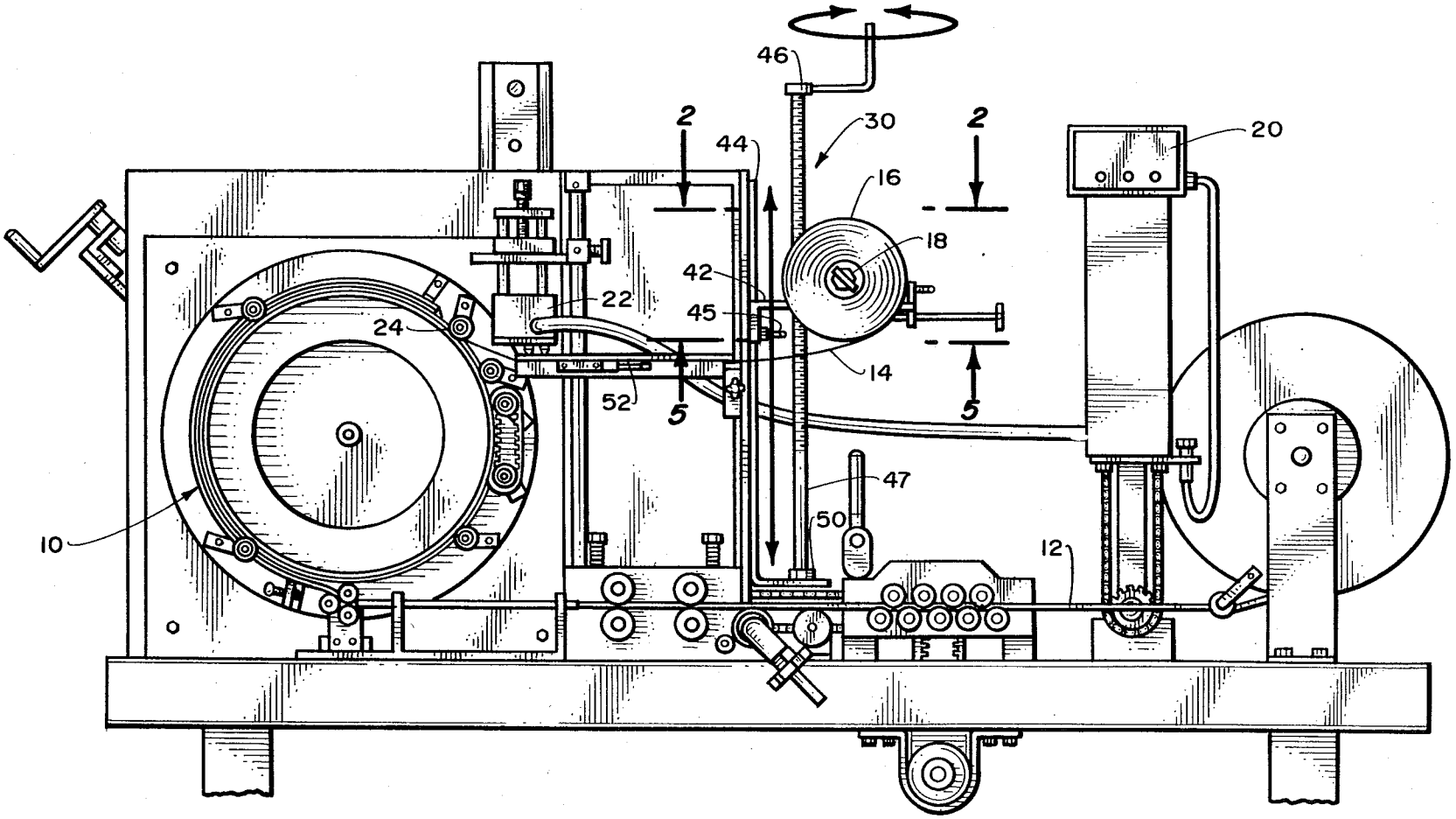
FIG. 1 is a front elevation of a duct forming machine having the strip material feed alignment compensating system according to the invention.
Figure 2:
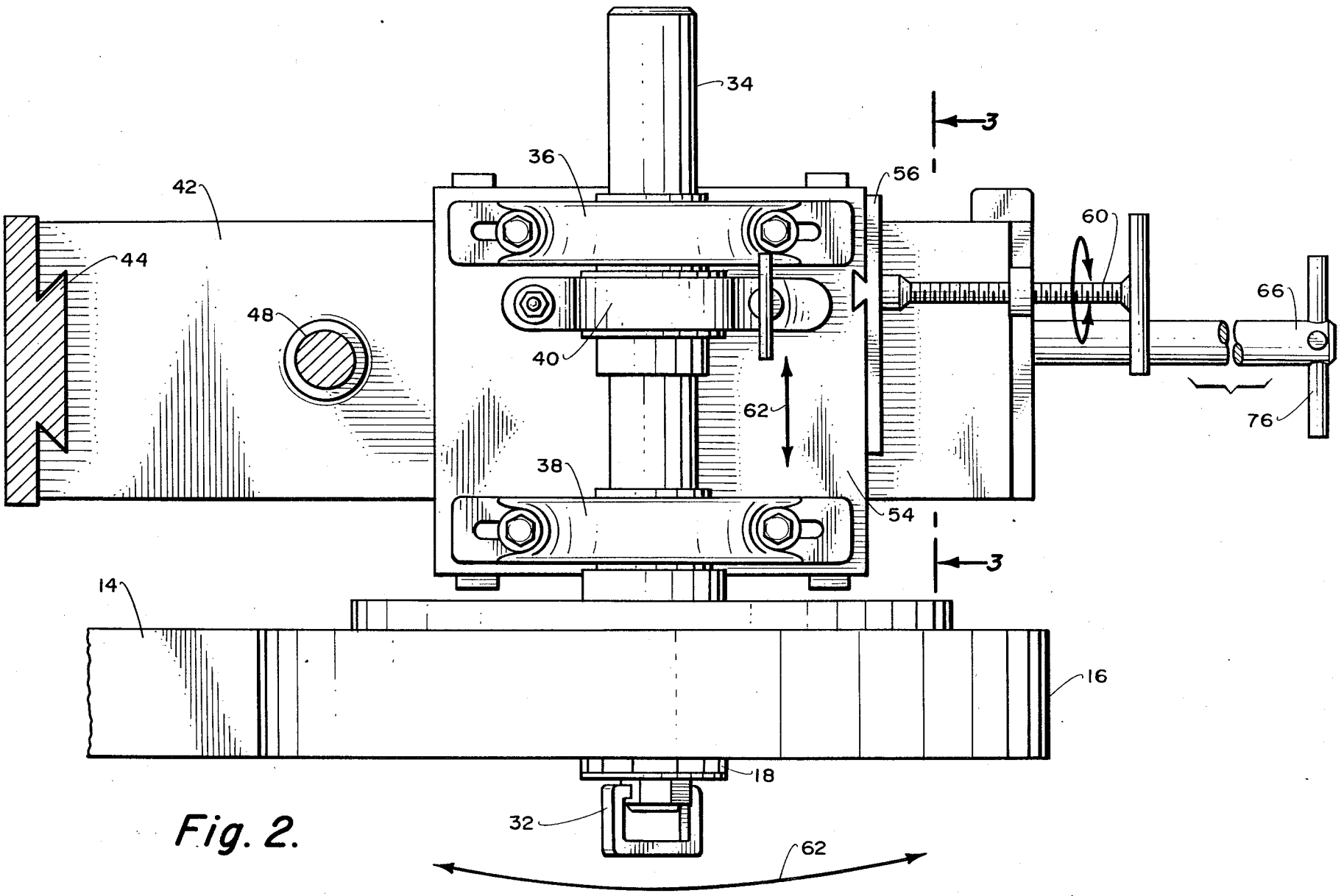
FIG. 2 is a view of the strip material feed alignment compensating system taken at 2—2 of FIG. 1.

A duct forming machine such as that shown and described in U.S. Pat. No. 4,351,682 is shown in FIG. 1. A flexible duct core is formed on mandrel 10 by continuously winding reinforcing wire 12 onto the mandrel in a helix and encapsulating the reinforcing wire in strip material 14 fed from spool 16 rotatably mounted on a hub 18. The strip material 14 is several inches wide and is fed in overlapping wraps onto mandrel 10 with reinforcing wire 12 being positioned between the successive overlapping edges of the material. Glue from glue pot 20 is simultaneously fed from adhesive dispensing head 22 and laid down in narrow streams along the strip material 14 at the overlapping edges and pressed firmly around reinforcing wire 12 by rollers 24.

Flexible strip material 14 must be evenly wrapped around the mandrel 10. Thus, it is imperative that strip material 14 be fed evenly and in proper alignment when passing beneath the adhesive dispensing head 22 and rollers 24. Any misalignment can cause buckling or crimping of the overlapping edges preventing a good seal.

The present invention allows alignment compensation for maintaining alignment of the strip material feeding system indicated generally at 30 which is shown in greater detail in FIGS. 2 through 5. The strip feed material 14 is supplied from a large spool 16 mounted on hub 18 by a quick disconnect ring 32 which allows spools to be quickly changed when empty or if a spool of different material is to be mounted. The spool mounting 18 is mounted on a rotable shaft or axle 34 mounted in bearings 36 and 38. An adjustable brake 40 is provided to adjust the tension and damp the rotation of spool 16 to prevent strip material 14 from being fed too loosely.

Adjustments to the strip material feeding system are provided to compensate and align the material vertically, horizontally and angularly. As the spool 16 decreases in size, such that strip material 14 is being fed at an increasing downward angle mounting platform 42 is vertically adjusted to realign the material. Mounting plate 42 is mounted with flange 49 engaged in dovetail fitting 44 on the machine frame and permits the strip material feed system to be vertically adjusted according to a change in diameter of the strip material spool 16. Mounting plate 42 is raised or lowered by means of crank 46 on lead screw 47 threaded through bushing 48 mounted on the platform seated in a second bushing 50 mounted on the machine frame. Rotation of the crank 46 adjusts the vertical position of platform 42 to keep strip material 14 substantially horizontal or parallel with the feed plate 52 over which the material passes.

The vertical position of mounting platform 42 is clamped by means of threaded screw 45 which is tightened against dove tail support 44 after vertical adjustment. The screw 45 is threaded through nut 43 attached to flange 49 on platform 42.

Angular compensating adjustments can also be made to drive shaft mounting plate 54 to align the strip material feed system. Flange 56 mounted on axle or drive shaft mounting plate 54 has a slot 58 receiving adjustment screw 60. Adjustment of the screw 60, adjusts the angular position, as indicated by arrow 62, of axle or drive shaft 34 to align the strip feed material 14.

Horizontal adjustment compensation or position of the spool is provided by rotatable shaft 66 having gears 68 and 70 engaging gear racks 72 and 74 secured to drive shaft mounting plate 54 beneath mounting platform 42. Rotation of handle 76 on shaft 66 causes drive shaft mounting plate 54 to be moved horizontally away from or toward the mounting platform 42 as can be seen more clearly in FIG. 3. This adjustment provides horizontal positioning or adjustment compensation of the strip material to assure proper alignment with the glue system and mandrel.

Figure 5:
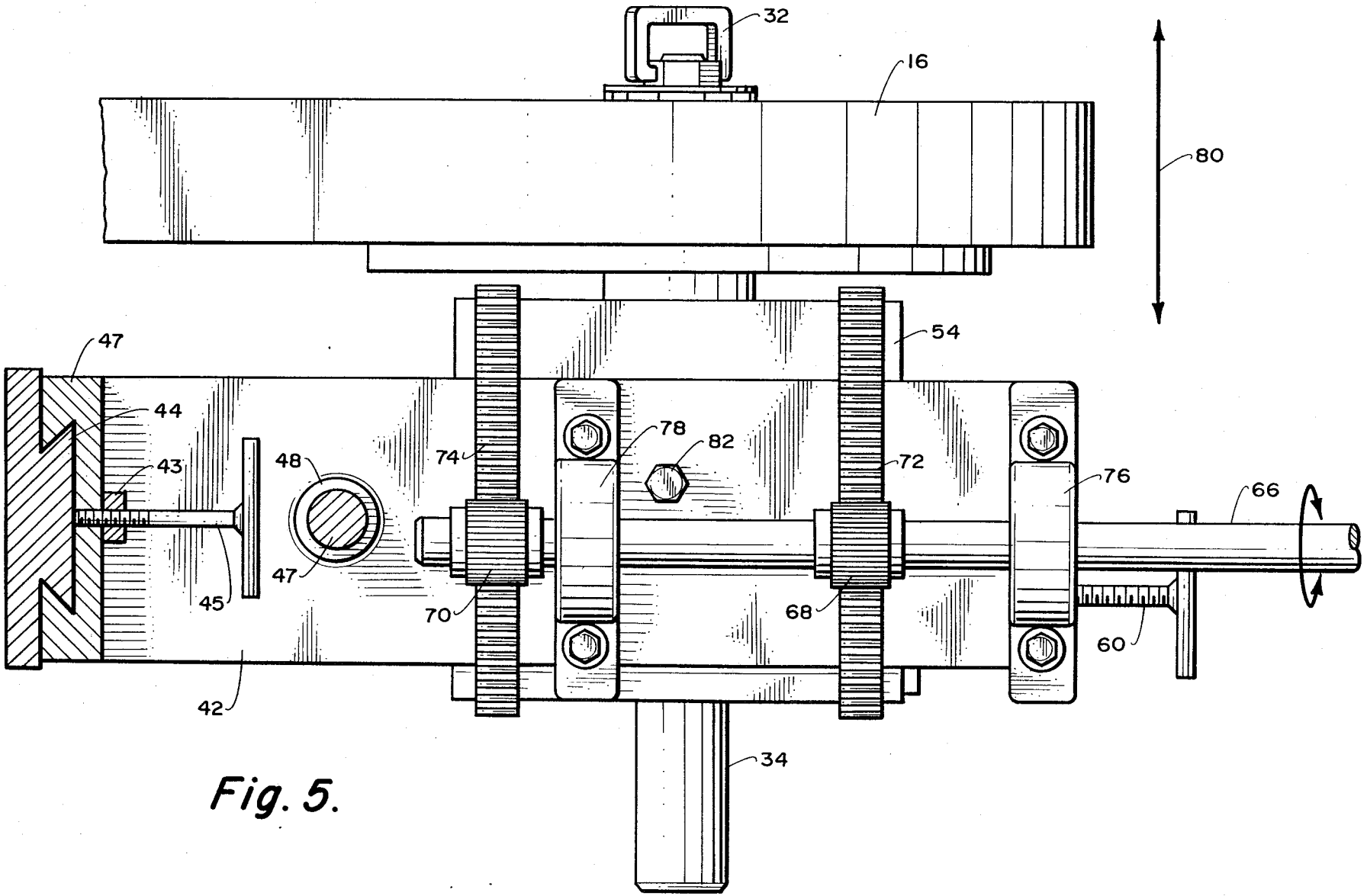
FIG. 5 is a sectional view taken at 5—5 of FIG. 1.

Shaft 66 for horizontal adjustment of the feed system is mounted on platform 42 by means of bearings 76 and 78 as can be seen in FIG. 5. This provides smooth operation and engagement of the gears and gear rack to allow fine horizontal adjustments of spool 16 as indicated by arrow 80. Rotation of shaft 66 rotates gears 68 and 70 engaging rack gear 72 and 74 to move plate 54 horizontally in or out for proper alignment.

Figure 3:
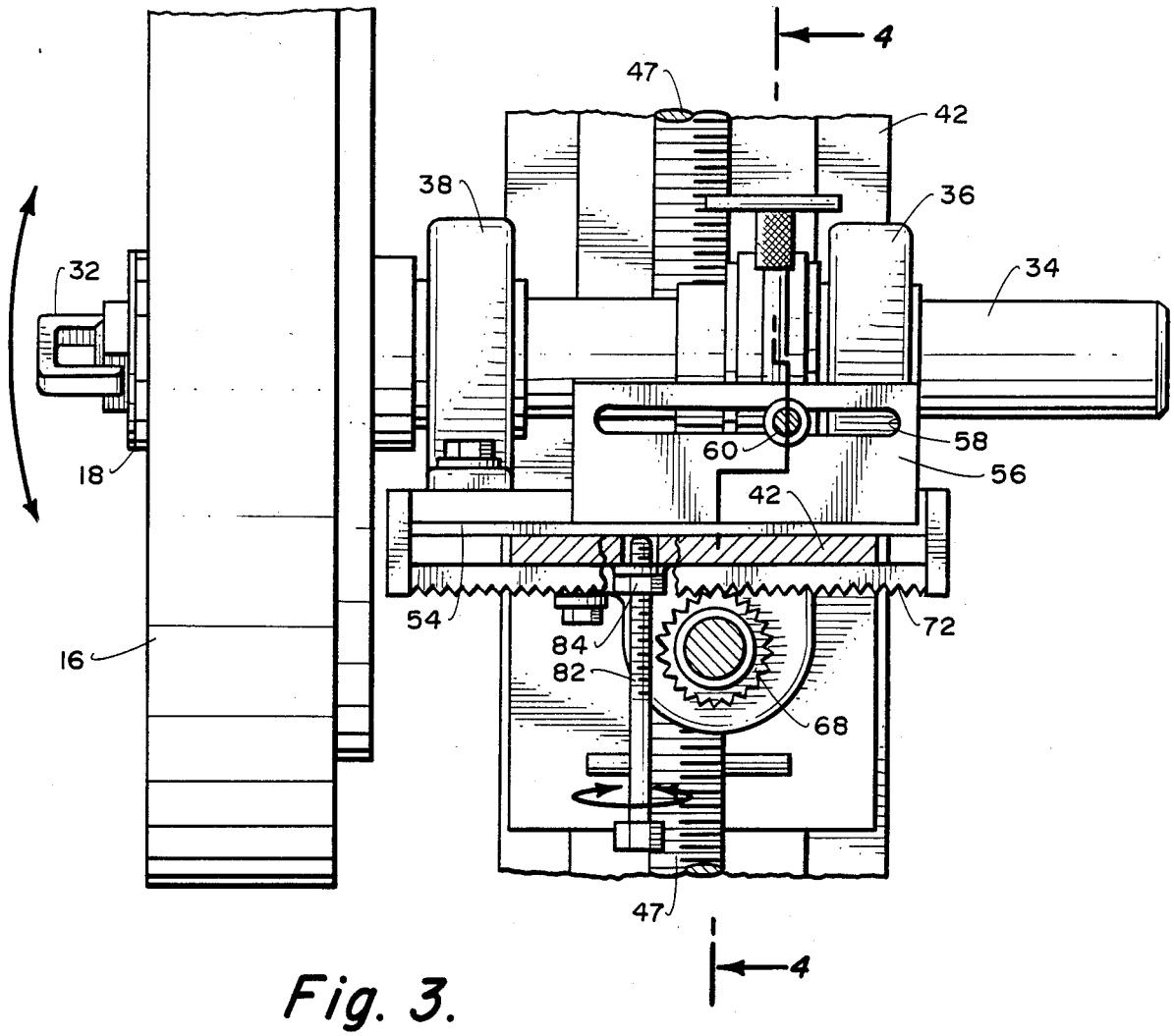
FIG. 3 is a sectional view taken at 3—3 of FIG. 2.
Figure 4:
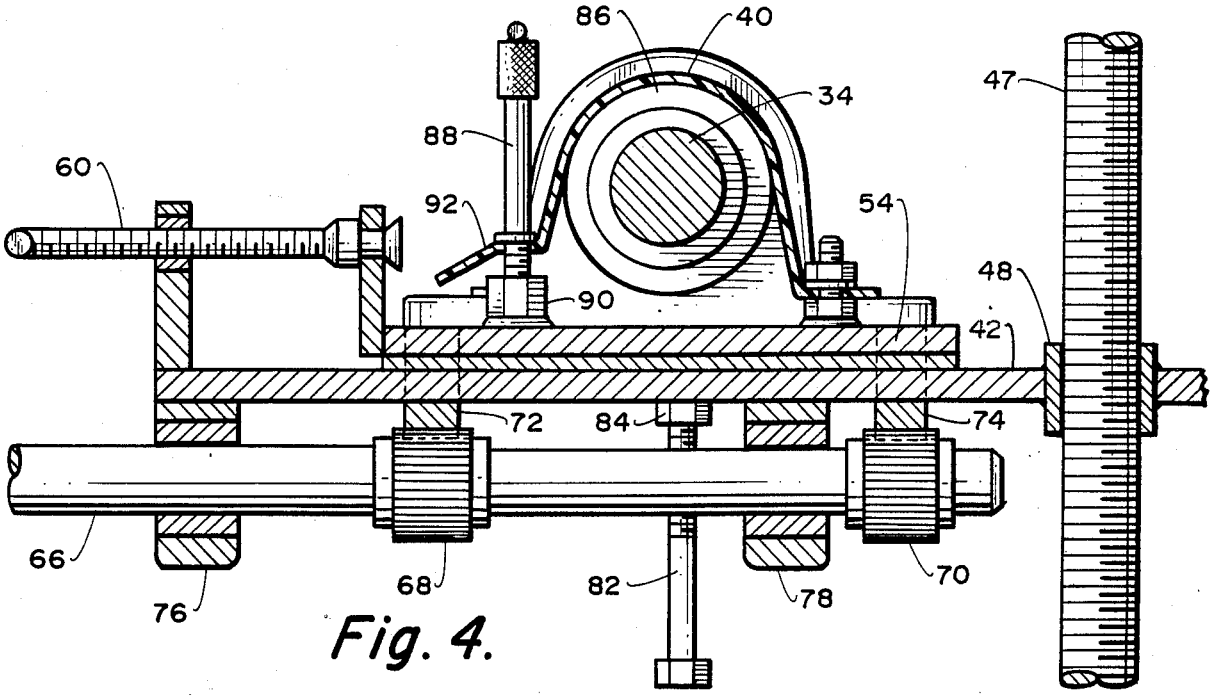
FIG. 4 is a sectional view taken at 4—4 of FIG. 3.

After horizontal and angular compensating alignments have been completed plate 54 is clamped by tightening bolt 82 threaded through nut 84 mounted on the bottom of the platform as can be seen in FIGS. 3 through 5. Platform 42 is positioned vertically by operation of crank 46 and clamping with screw 45 before horizontal position adjustments are made with shaft 16 and screw 60 to properly position axle mounting plate 54 so that material being fed from spool 66 is properly aligned.

A brake or drag mechanism is provided by strap 40 applying an adjustable frictional force to shoe 86 mounted on axle shaft 34 to adjust the tension of the strip material feed. Screw 88 threaded into socket 90 passing through end or tab 92 of strap 40 adjusts the tension. The strap is loosened or tightened to control the tension feed from spool 16 to keep the material taut as it is being fed to the mandrel.

In operation an empty spool 16 is replaced by removing clamping ring 32 from hub 18 on the end of axle 34. A new spool is placed on the hub and the clamp ring 32 replaced and tightened. Since initially a new spool 16 will have a large diameter crank 46 is operated so that the bottom of spool 16 is approximately level with the plate 52 feeding the strip material beneath the glue head 22 to mandrel 10. After vertical alignment horizontal adjustments are made by rotation of screw 60 and shaft 66 to properly align spool 16 horizontally and angularly. The adjustments are then locked by tightening the screw 45 and bolt 82. From time to time as the diameter of the spool 16 decreases vertical readjustment are made with crank 46. Clamp 45, is releases and crank 46 operates to lower spool 16 when the feed angle becomes too great. The machine is preferably not be stopped while this adjustment is being made. Horizontal angular or position adjustments may also be necessary.

Thus there has been disclosed a unique microadjustable alignment compensating strip material feed system for a duct forming machine in which proper vertical, horizontal and angular alignments are easily accomplished.

This invention is not to be limited by the embodiment shown in the drawings and described in the description which is given by way of example and not of limitation but only in accordance with the scope of the impendng claims.

What is claimed is:

1. In a duct forming machine having reinforcing wire and strip material fed to a rotating mandrel with the strip material overlapping and encapsulating the reinforcing wire the improvement comprising:

a spool of flexible strip material rotatably mounted on an axle being fed to said duct forming machine mandrel;

platform mounting means for mounting said axle;

vertical adjustment means for adjusting the vertical position of said platform mounting means to align said strip material with respect to said rotating mandrel;

horizontal adjusting means for adjusting the horizontal position of said axle on said platform mounting means to align said spool with respect to said rotating mandrel; and horizontal angular adjustment means for adjusting the horizontal angular position of said axle with respect to said mandrel;

whereby alignment of said spool with said mandrel may be easily made by adjusting said platform mounting means vertically and adjusting the horizontal and angular position of said axle mounted on said platform.

2. The duct forming machine according to claim 1 in which said platform mounting means has a flange having a dovetail joint engaging a mating dovetail joint on a frame portion of said duct forming machine whereby said platform mounting means may be vertically adjusted.

3. The duct forming machine according to claim 2 including a lead screw passing through a threaded bushing on said platform mounting means; one end of said lead screw resting on a socket mounted on said duct forming machine whereby rotation of said lead screw causes vertical movement of said platform mounting means relative to said rotating mandrel.

4. The duct forming machine according to claim 1 in which said horizontal adjusting means comprises;

a bearing plate supporting said axle;

means for horizontally adjusting said bearing plate.

5. The duct forming machine according to claim 4 in which said bearing plate is mounted on said platform mounting means for simultaneous adjustment therewith.

6. The duct forming machine according to claim 5 in which said horizontal adjusting means includes;

a rack gear on said bearing plate;

a rotatable shaft;

gear means on said rotatable shaft engaging said rack gear;

whereby rotation of said shaft rotates said gear means to horizontally adjust said bearing plate.

7. The duct forming machine according to claim 6 in which said horizontal angular adjustment comprises means for angularly deflecting said bearing plate whereby the horizontal angle of said spool axle can be adjusted.

8. The duct forming machine according to claim 7 in which said means for angularly deflecting said bearing plate comprises a flange on said bearing plate; and a fixed thumbscrew abutting said flange whereby rotation of said thumbscrew causes angular deflection of said bearing plate.

9. The duct forming machine according to claim 3 in which said horizontal adjusting means comprises;

a bearing plate supporting said axle;

means for horizontally adjusting said bearing plate.

10. The duct forming machine according to claim 9 in which said horizontal adjusting means comprises;

a bearing plate supporting said axle;

means for horizontally adjusting said bearing plate.

11. The duct forming machine according to claim 10 in which said bearing plate is mounted on said vertical adjusting means for simultaneous adjustment therewith.

12. The duct forming machine according to claim 11 in which said horizontal adjusting means includes; a rack gear on said bearing plate; a rotatable shaft; gear means on said rotatable shaft engaging said rack gears; whereby rotation of said shaft rotates said gear means to horizontally adjust said bearing plate.

13. The duct forming machine according to claim 12 in which said horizontal angular adjustments comprises means for angularly deflecting said bearing plate whereby the horizontal angle of said spool axle an be adjusted.

* * * * *